US008608876B2

(12) United States Patent
Khosla et al.

(10) Patent No.: US 8,608,876 B2
(45) **Date of Patent: *Dec. 17, 2013**

(54) AA7000-SERIES ALUMINUM ALLOY PRODUCTS AND A METHOD OF MANUFACTURING THEREOF

(75) Inventors: Sunil Khosla, Beverwijk (NL); Andrew Norman, Beverwijk (NL); Hugo Van Schoonevelt, Noordbeemster (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 111 days.

This patent is subject to a terminal disclaimer.

(21) Appl. No.: 11/773,919

(22) Filed: Jul. 5, 2007

(65) Prior Publication Data

US 2008/0173378 A1 Jul. 24, 2008

Related U.S. Application Data

(60) Provisional application No. 60/818,983, filed on Jul. 7, 2006.

(51) Int. Cl.

| | |
|---|---|
| ***C22F 1/04*** | (2006.01) |
| *C22C 21/06* | (2006.01) |
| *C22C 21/00* | (2006.01) |
| *C22C 21/10* | (2006.01) |

(52) U.S. Cl.
USPC ..... 148/552; 148/439; 420/532; 420/541

(58) Field of Classification Search
USPC ..... 148/415, 417, 418, 550, 552, 439; 420/529, 531–534, 540–542
See application file for complete search history.

(56) References Cited

U.S. PATENT DOCUMENTS

| | | | | |
|---|---|---|---|---|
| 2,249,349 | A | | 7/1941 | Deutsch |
| 3,287,185 | A | | 11/1966 | Vachet |
| 3,305,410 | A | | 2/1967 | Sublett et al. |
| 3,418,090 | A | | 12/1968 | Fritzlen |
| 3,674,448 | A | | 7/1972 | Brown et al. |
| 3,791,876 | A | | 2/1974 | Kroger |
| 3,791,880 | A | * | 2/1974 | Hunsicker et al. ..... 428/553 |
| 3,794,531 | A | | 2/1974 | Markworth |
| 3,826,688 | A | | 7/1974 | Levy |
| 3,857,973 | A | | 12/1974 | McKee et al. |
| 3,881,966 | A | | 5/1975 | Staley et al. |
| 3,984,259 | A | | 10/1976 | Rogers, Jr. et al. |
| 4,140,549 | A | | 2/1979 | Chia et al. |
| 4,189,334 | A | | 2/1980 | Dubost et al. |
| 4,196,021 | A | | 4/1980 | Bouvaist et al. |
| 4,305,763 | A | | 12/1981 | Quist et al. |
| 4,462,843 | A | | 7/1984 | Baba et al. |
| 4,462,893 | A | | 7/1984 | Moriya et al. |
| 4,477,292 | A | | 10/1984 | Brown |
| 4,589,932 | A | | 5/1986 | Park |
| 4,618,382 | A | | 10/1986 | Miyagi et al. |
| 4,659,393 | A | | 4/1987 | Bouvaist et al. |
| 4,711,762 | A | | 12/1987 | Vernam et al. |
| 4,713,216 | A | | 12/1987 | Higashi et al. |
| 4,828,631 | A | | 5/1989 | Ponchel et al. |
| 4,927,470 | A | | 5/1990 | Cho |
| 4,946,517 | A | | 8/1990 | Cho |
| 4,954,188 | A | | 9/1990 | Ponchel et al. |
| 4,976,790 | A | | 12/1990 | McAuliffe et al. |
| 4,988,394 | A | | 1/1991 | Cho |
| 5,108,520 | A | | 4/1992 | Liu et al. |
| 5,186,235 | A | | 2/1993 | Word, Jr. |
| 5,213,639 | A | | 5/1993 | Colvin et al. |
| 5,221,377 | A | | 6/1993 | Hunt, Jr. et al. |
| 5,277,719 | A | | 1/1994 | Kuhlman et al. |
| 5,312,498 | A | | 5/1994 | Anderson |
| 5,313,639 | A | | 5/1994 | Chao |
| 5,356,495 | A | | 10/1994 | Wyatt-Mair et al. |
| 5,496,423 | A | | 3/1996 | Wyatt-Mair et al. |
| 5,496,426 | A | | 3/1996 | Murtha |
| 5,560,789 | A | | 10/1996 | Sainfort et al. |
| 5,593,516 | A | | 1/1997 | Cassada, III |
| 5,624,632 | A | | 4/1997 | Baumann et al. |
| 5,681,405 | A | | 10/1997 | Newton et al. |
| 5,718,780 | A | | 2/1998 | Bryant et al. |
| 5,738,735 | A | | 4/1998 | Bechet |
| 5,833,775 | A | | 11/1998 | Newton et al. |
| 5,858,134 | A | | 1/1999 | Bechet et al. |

(Continued)

FOREIGN PATENT DOCUMENTS

| | | |
|---|---|---|
| DE | 102004010700 | 10/1991 |
| DE | 68927149 | 4/1997 |

(Continued)

OTHER PUBLICATIONS

U.S. Appl. No. 11/773,900, Khosla et al., filed Jul. 5, 2007.
U.S. Appl. No. 11/773,904, Khosla et al., filed Jul. 5, 2007.
Airbus Industriele Material Specification AIMS 03-02-020 (Feb. 2002).
Hufnagel, W., Key to Aluminium Alloys, 4th Edition, Aluminium-Schluessel = Key to Aluminium Alloys, pp. 195-205 (XP-002194851) (1991).
International Preliminary Report on Patentability in application PCT/EP2007/005972 mailed on Jan. 22, 2009, international stage of U.S. Appl. No. 11/773,900, (11 pages).
International Preliminary Report on Patentability in application PCT/EP2007/005973 mailed on Jan. 22, 2009, international stage of U.S. Appl. No. 11/773,904 (12 pages).

(Continued)

*Primary Examiner* — Roy King
*Assistant Examiner* — Caitlin Kiechle
(74) *Attorney, Agent, or Firm* — Novak Druce Connolly Bove + Quigg LLP

(57) ABSTRACT

An AA7000-series alloy including 3 to 10% Zn, 1 to 3% Mg, at most 2.5% Cu, Fe<0.25%, and Si<0.12%. Also, a method of manufacturing aluminum wrought products in relatively thick gauges, i.e. about 30 to 300 mm thick. While typically practiced on rolled plate product forms, this method may also find use with manufacturing extrusions or forged product shapes. Representative structural component parts made from the alloy product include integral spar members, and the like, which are machined from thick wrought sections, including rolled plate.

37 Claims, No Drawings

(56) References Cited

U.S. PATENT DOCUMENTS

| | | | |
|---|---|---|---|
| 5,865,911 | A | 2/1999 | Miyasato et al. |
| 5,865,914 | A | 2/1999 | Karabin et al. |
| 5,888,320 | A | 3/1999 | Dorward |
| 5,938,867 | A | 8/1999 | Dorward et al. |
| 6,027,582 | A | 2/2000 | Shahani et al. |
| 6,048,415 | A | 4/2000 | Nakai et al. |
| 6,120,623 | A | 9/2000 | Gupta et al. |
| 6,129,792 | A | 10/2000 | Murtha |
| 6,224,992 | B1 | 5/2001 | Delbeke et al. |
| 6,238,495 | B1 | 5/2001 | Haszler |
| 6,315,842 | B1 | 11/2001 | Shahani et al. |
| 6,337,147 | B1 | 1/2002 | Haszler et al. |
| 6,444,058 | B1 | 9/2002 | Liu et al. |
| 6,543,122 | B1 | 4/2003 | Perkins et al. |
| 6,562,154 | B1 | 5/2003 | Rioja et al. |
| 6,569,542 | B2 | 5/2003 | Warner et al. |
| 6,602,361 | B2 | 8/2003 | Warner et al. |
| 6,627,330 | B1 | 9/2003 | Shimizu et al. |
| 6,652,678 | B1 | 11/2003 | Marshall et al. |
| 6,726,878 | B1 | 4/2004 | Flidlyander et al. |
| 6,743,308 | B2 | 6/2004 | Tanaka et al. |
| 6,790,407 | B2 | 9/2004 | Fridlyander |
| 6,972,110 | B2 | 12/2005 | Chakrabarti et al. |
| 6,994,760 | B2 | 2/2006 | Benedictus et al. |
| 7,060,139 | B2 | 6/2006 | Senkovet et al. |
| 7,097,719 | B2 | 8/2006 | Bray et al. |
| 7,250,223 | B2 | 7/2007 | Miyachi et al. |
| 7,294,213 | B2 | 11/2007 | Warner et al. |
| 7,550,110 | B2 | 6/2009 | Warner et al. |
| 2001/0006082 | A1 | 7/2001 | Warner et al. |
| 2001/0039982 | A1 | 11/2001 | Sigli et al. |
| 2002/0011289 | A1 | 1/2002 | Warner |
| 2002/0014288 | A1 | 2/2002 | Warner et al. |
| 2002/0014290 | A1 | 2/2002 | Dif et al. |
| 2002/0039664 | A1 | 4/2002 | Magnusen et al. |
| 2002/0043311 | A1 | 4/2002 | Selepack et al. |
| 2002/0121319 | A1 | 9/2002 | Chakrabarti et al. |
| 2002/0150498 | A1 | 10/2002 | Chakrabarti et al. |
| 2002/0153072 | A1 | 10/2002 | Tanaka et al. |
| 2002/0162609 | A1 | 11/2002 | Warner |
| 2003/0140990 | A1 | 7/2003 | Ribes et al. |
| 2003/0219353 | A1 | 11/2003 | Warner et al. |
| 2004/0007295 | A1 | 1/2004 | Lorentzen et al. |
| 2004/0101434 | A1 | 5/2004 | Fridlyander et al. |
| 2004/0109787 | A1 | 6/2004 | Haszler et al. |
| 2004/0211498 | A1 | 10/2004 | Keidel et al. |
| 2005/0006010 | A1 | 1/2005 | Benedictus et al. |
| 2005/0034794 | A1 | 2/2005 | Benedictus et al. |
| 2005/0067066 | A1 | 3/2005 | Tanaka et al. |
| 2005/0072497 | A1 | 4/2005 | Eberl et al. |
| 2005/0081965 | A1 | 4/2005 | Benedictus et al. |
| 2005/0095447 | A1 | 5/2005 | Baumann et al. |
| 2005/0189044 | A1 | 9/2005 | Benedictus et al. |
| 2006/0016523 | A1 | 1/2006 | Dif et al. |
| 2006/0032560 | A1 | 2/2006 | Benedictus et al. |
| 2006/0083654 | A1 * | 4/2006 | Chakrabarti et al. ..... 420/532 |
| 2006/0174980 | A1 | 8/2006 | Benedictus et al. |
| 2006/0182650 | A1 | 8/2006 | Eberl et al. |
| 2007/0000583 | A1 | 1/2007 | Rioja et al. |
| 2007/0151636 | A1 | 7/2007 | Buerger et al. |
| 2007/0204937 | A1 | 9/2007 | Buerger et al. |
| 2008/0173377 | A1 | 7/2008 | Khosla et al. |
| 2008/0210349 | A1 | 9/2008 | Khosla et al. |
| 2009/0269608 | A1 | 10/2009 | Benedictus et al. |
| 2009/0320969 | A1 | 12/2009 | Benedictus et al. |
| 2010/0183474 | A1 | 7/2010 | Lin et al. |

FOREIGN PATENT DOCUMENTS

| | | | |
|---|---|---|---|
| DE | 10392805 | | 6/2005 |
| EP | 0081441 | | 6/1983 |
| EP | 0368005 | | 5/1990 |
| EP | 0377779 | | 7/1990 |
| EP | 0 462 055 | A1 | 12/1991 |
| EP | 0587274 | | 3/1994 |
| EP | 0605947 | | 7/1994 |
| EP | 0670377 | | 9/1995 |
| EP | 0799900 | | 10/1997 |
| EP | 0829552 | | 3/1998 |
| EP | 0876514 | | 11/1998 |
| EP | 989195 | | 3/2000 |
| EP | 1026270 | | 8/2000 |
| EP | 1045043 | | 10/2000 |
| EP | 1114877 | | 7/2001 |
| EP | 1143027 | | 10/2001 |
| EP | 1158068 | | 11/2001 |
| EP | 1170394 | | 1/2002 |
| EP | 1231290 | | 8/2002 |
| EP | 1306455 | | 2/2003 |
| EP | 1382698 | A1 | 1/2004 |
| FR | 1508123 | | 1/1968 |
| FR | 2066696 | | 8/1971 |
| FR | 2163281 | A5 | 7/1973 |
| FR | 2234375 | | 1/1975 |
| FR | 2409319 | | 6/1979 |
| FR | 2472618 | | 7/1981 |
| FR | 2716896 | | 9/1995 |
| FR | 2841263 | | 12/2003 |
| FR | 2846669 | | 5/2004 |
| FR | 2855834 | | 12/2004 |
| GB | 925956 | B | 5/1963 |
| GB | 0952288 | | 3/1964 |
| GB | 1029486 | | 5/1966 |
| GB | 1231090 | | 5/1971 |
| GB | 1273261 | | 5/1972 |
| GB | 1427657 | | 3/1976 |
| GB | 2065516 | | 7/1981 |
| GB | 1603690 | | 11/1981 |
| GB | 2114601 | | 8/1983 |
| GB | 2430937 | | 4/2007 |
| JP | 61049796 | | 3/1976 |
| JP | 59126762 | | 7/1984 |
| JP | 62010246 | | 1/1987 |
| JP | 62122745 | | 6/1987 |
| JP | 62122744 | | 8/1987 |
| JP | 63319143 | | 12/1988 |
| JP | 1039340 | | 2/1989 |
| JP | 1208438 | | 8/1989 |
| JP | 2047244 | | 2/1990 |
| JP | 06128678 | | 5/1994 |
| JP | 6228691 | | 8/1994 |
| JP | 8120385 | | 5/1996 |
| JP | 8144031 | | 6/1996 |
| JP | 09279284 | | 10/1997 |
| JP | 10280081 | | 10/1998 |
| JP | 10298692 | | 11/1998 |
| JP | 2001020028 | | 1/2001 |
| JP | 2001115227 | | 4/2001 |
| JP | 2002241882 | | 8/2002 |
| JP | 2003147498 | | 5/2003 |
| RU | 2044098 | | 9/1995 |
| RU | 1625043 | | 10/1995 |
| RU | 2165996 | | 4/2001 |
| RU | 2184166 | C2 | 6/2002 |
| RU | 2215058 | C1 | 10/2003 |
| RU | 2215807 | C2 | 11/2003 |
| RU | 2215808 | | 11/2003 |
| RU | 2003106552 | A | 10/2004 |
| SU | 664570 | | 5/1979 |
| WO | 9203586 | | 3/1992 |
| WO | 9526420 | | 10/1995 |
| WO | 9610099 | | 4/1996 |
| WO | 9628582 | | 9/1996 |
| WO | 9629440 | | 9/1996 |
| WO | 9722724 | | 6/1997 |
| WO | 9837251 | | 8/1998 |
| WO | 0054967 | | 9/2000 |
| WO | 0210468 | | 2/2002 |
| WO | 02052053 | | 7/2002 |
| WO | 02075010 | | 9/2002 |
| WO | 03076677 | | 9/2003 |
| WO | 03085146 | | 10/2003 |
| WO | 2004001080 | | 12/2003 |

(56) References Cited

FOREIGN PATENT DOCUMENTS

| | | | |
|---|---|---|---|
| WO | 2004044256 | | 5/2004 |
| WO | 2004/090183 | A1 | 10/2004 |
| WO | 2004111282 | | 12/2004 |
| WO | 2005003398 | | 1/2005 |

OTHER PUBLICATIONS

International Preliminary Report on Patentability in application PCT/EP2007/005975 mailed on Jan. 22, 2009, international stage of U.S. Appl. No. 11/773,919, (12 pages).
Office action for U.S. Appl. No. 11/480,558, mailed Dec. 31, 2008 (14 pages).
Office action for U.S. Appl. No. 11/773,900, mailed Mar. 17, 2009 (13 pages).
Office action for U.S. Appl. No. 11/773,904, mailed Mar. 16, 2009 (18 pages).
Vojtech et al., Improving the casting properties of high-strength aluminum alloys, Materiali in Technologiji 38 (2004), pp. 99-102.
P.T. Houldcroft, "A Simple Cracking Test for Use with Argon-Arc Welding", British Welding Journal, Oct. 1955, pp. 471-475.
Pechiney Aluminium: "Demi produits aluminium; Caracteristiques generales—Aluminium mill products; general properties;" Oct. 1985, Announcement Pechiney Aluminium, pp. 1-5, XP002240985 the whole document.
M.S. degree thesis of L.E. Oswald, titled "Effects of microstructure on high-cycle fatigue of an Al—Zn—Mg—Cu alloy (AL-7055)", pp. i-x and 1-54 (Apr. 2003).
Office action of Jul. 15, 2009 from U.S. Appl. No. 11/480,558.
Office action of Sep. 9, 2009 from U.S. Appl. No. 11/566,630.
Office action of Sep. 29, 2009 from U.S. Appl. No. 11/773,904.
Office action of Sep. 24, 2009 from U.S. Appl. No. 11/773,900.
Advisory action of Oct. 30, 2009 from U.S. Appl. No. 11/480,558.
Conversion table for hardness and tensile strength value—DIN EN ISO 18265—Nov. 2003.
Advisory Action dated Jan. 11, 2010, issued in co-pending U.S. Appl. No. 11/773,900.
Non-Final Rejection dated Mar. 4, 2010, in co-pending U.S. Appl. No. 11/773,900.
Final Rejection dated Mar. 11, 2010, in co-pending U.S. Appl. No. 11/566,630.
Final Rejection dated Mar. 4, 2010, in co-pending U.S. Appl. No. 11/773,904.
Arai et al., ASM Handbook, Heat Treating of Aluminum Alloys-Strengthening by Heat Treatment, ASM International, vol. 4, 1995, p. 5-7.
U.S. Appl. No. 11/733,900—Final Office action mailed Aug. 8, 2010.
U.S. Appl. No. 11/239,651—Notice of Allowance mailed Sep. 24, 2010.
"Heat Treating of Aluminum Alloys," ASM Handbook, vol. 4, pp. 841-856, 1995.
Lakhtin Yu. M. et al. Material Science, Moscow, "Machine Construction" 1980, p. 40.
V.I. Dobatkin, Smelting and Casting of Aluminum Alloys, Moscow, "Metallurgy", 1970, p. 27.
The Russian State Standard GOST 4784-97; Aluminum and wrought aluminum alloys , rades, Minsk, Publisher or Standards, 1999, p. 7, 8, Table 6.
International Alloy Designations and Chemical Composition Limits for Wrought Aluminum and Wrought Aluminum Alloys (teak sheets), The Aluminum Association, miscellaneous annotated pages (Jul. 1998).
"Aluminum Viewed from Within", Altenpohl, 1st edition, pp. 118-131 (1982).
ASM Specialty Handbook, Aluminum and Aluminum Alloys, edited by J.R. Davis, ASM International, pp. 247-248, 1993.
Aluminum Properties and Physical Metallurgy, edited by J.E. Hatch, American Society for Metals, p. 112-113 (1984).
Aluminium-Taschenbuch 15. Auflage, Dorossel et al., p. 20-25 (1999).
Advisory Action mailed in U.S. Appl. No. 11/566,630 on Jun. 24, 2010, 3 pages.
Requirement for Restriction / Election mailed in U.S. Appl. No. 11/566,630 on Jun. 19, 2009, 6 pages.
Final Rejection mailed in U.S. Appl. No. 12/547,466 on Jul. 12, 2010, 13 pages.
Non-Final Rejection mailed in U.S. Appl. No. 12/547,466 on Jan. 28, 2010, 11 pages.
Advisory Action mailed in U.S. Appl. No. 10/819,130 on May 6, 2008, 4 pages.
Advisory Action mailed in U.S. Appl. No. 10/819,130 on Jul. 13, 2009, 3 pages.
Final Rejection mailed in U.S. Appl. No. 10/819,130 on Jan. 25, 2008, 9 pages.
Final Rejection mailed in U.S. Appl. No. 10/819,130 on Feb. 26, 2009, 7 pages.
Non-Final Rejection mailed in U.S. Appl. No. 10/819,130 on Jun. 22, 2007, 8 pages.
Non-Final Rejection mailed in U.S. Appl. No. 10/819,130 on Aug. 5, 2008, 8 pages.
Requirement for Restriction / Election mailed in U.S. Appl. No. 10/819,130 on Apr. 3, 2007, 5 pages.
Advisory Action mailed in U.S. Appl. No. 10/821,184 on Jun. 4, 2008, 4 pages.
Final Rejection mailed in U.S. Appl. No. 10/821,184 on Nov. 21, 2008, 9 pages.
Final Rejection mailed in U.S. Appl. No. 10/821,184 on Feb. 21, 2008, 14 pages.
Non-Final Rejection mailed in U.S. Appl. No. 10/821,184 on Jun. 26, 2007, 11 pages.
Non-Final Rejection mailed in U.S. Appl. No. 10/821,184 on Sep. 3, 2008, 14 pages.
Requirement for Restriction / Election mailed in U.S. Appl. No. 10/821,184 on Apr. 3, 2007, 5 pages.
Advisory Action mailed in U.S. Appl. No. 10/976,154 on Nov. 21, 2008, 4 pages.
Final Rejection mailed in U.S. Appl. No. 10/976,154 on Oct. 15, 2009, 17 pages.
Final Rejection mailed in U.S. Appl. No. 10/976,154 on May 29, 2008, 18 pages.
Non-Final Rejection mailed in U.S. Appl. No. 10/976,154 on Feb. 18, 2009, 16 pages.
Non-Final Rejection mailed in U.S. Appl. No. 10/976,154 on Sep. 20, 2007, 15 pages.
Advisory Action mailed in U.S. Appl. No. 11/239,651 on Feb. 24, 2009, 3 pages.
Advisory Action mailed in U.S. Appl. No. 11/239,651 on Mar. 23, 2010, 3 pages.
Final Rejection mailed in U.S. Appl. No. 11/239,651 on Oct. 14, 2008, 10 pages.
Final Rejection mailed in U.S. Appl. No. 11/239,651 on Dec. 7, 2009, 10 pages.
Non-Final Rejection mailed in U.S. Appl. No. 11/239,651 on Feb. 22, 2008, 13 pages.
Non-Final Rejection mailed in U.S. Appl. No. 11/239,651 on Jun. 1, 2009, 10 pages.
Non-Final Rejection mailed in U.S. Appl. No. 11/239,651 on Jun. 8, 2010, 20 pages.
Non-Final Rejection mailed in U.S. Appl. No. 12/497,987 on May 26, 2010, 10 pages.
Advisory Action mailed in U.S. Appl. No. 11/773,904 on Jun. 11, 2010, 3 pages.
U.S. Appl. No. 11/566,630, filed Dec. 4, 2006, published as US 2007-0204937 A1 on Sep. 6, 2007.
U.S. Appl. No. 11/480,558, filed Jul. 5, 2006, published as US 2007-0151636 A1 on Jul. 5, 2007.
U.S. Appl. No. 12/547,466, filed Aug. 25, 2009, published as US 2009-0320969 A1 on Dec. 31, 2009.
U.S. Appl. No. 10/819,130, filed Apr. 7, 2004, published as US 2005-0034794 A1 on Feb. 17, 2005.
U.S. Appl. No. 10/821,184, filed Apr. 9, 2004, published as US 2005-0189044 A1 on Sep. 1, 2005, issued as U.S. Patent No. 7666267 on Feb. 23, 2010.

(56) References Cited

OTHER PUBLICATIONS

U.S. Appl. No. 10/976,154, filed Oct. 29, 2004, published as US 2006-0032560 A1 on Feb. 16, 2006.
U.S. Appl. No. 11/239,651, filed Sep. 30, 2005, published as US 2006-0174980 A1 on Aug. 10, 2006.
U.S. Appl. No. 12/497,987, filed Jul. 6, 2009, published as US 2009-0269608 A1 on Oct. 29, 2009.
Kuhlman, Forging of Aluminum Alloys-Forging Methods, vol. 14A, ASM Handbook, ASM International, p. 1-6 (2005).
U.S. Appl. No. 11/566,630—Non-Final Office action mailed Nov. 29, 2010.
U.S. Appl. No. 11/773,904—Non-Final Office action mailed Dec. 22, 2010.
U.S. Appl. No. 12/497,987—Final Office action mailed Jan. 6, 2011.
ASM Specialty Handbook Aluminum and Aluminum Alloys, J.R. Davis, ASM International, pp. 290-295 and 319-320 (1993).
Aluminum and Aluminum Alloys, ed. J.R. Davis, ASM International, 1993, p. 63.
Non-final Office Action mailed Feb. 3, 2012 in U.S. Appl. No. 12/497,987.
U.S. Appl. No. 12/547,466—Non-Final Office action mailed Mar. 31, 2011.
U.S. Appl. No. 11/566,630—Final Office action mailed Apr. 5, 2011.
Non-final Office action mailed Apr. 27, 2012, from U.S. Appl. No. 12/547,466 to Benedictus, filed Aug. 25, 2009.
Aluminum and Aluminum Alloys, ASM International, 1993, p. 23.
Non-final Office action mailed Aug. 20, 2012, from U.S. Appl. No. 11/566,630 to Buerger, filed Dec. 4, 2006.
Final Office Action mailed Sep. 7, 2011 in U.S. Appl. No. 12/547,466 (15 pages).
Non-Final Office Action mailed Aug. 12, 2011 in U.S. Appl. No. 12/497,987 (9 pages).

* cited by examiner

AA7000-SERIES ALUMINUM ALLOY PRODUCTS AND A METHOD OF MANUFACTURING THEREOF

CROSS-REFERENCE TO RELATED APPLICATIONS

This claims the benefit of U.S. provisional patent application No. 60/818,983, filed Jul. 7, 2006, incorporated herein by reference.

FIELD OF THE INVENTION

This invention relates to an AA7000-series alloy comprising 3 to 10% Zn, 1 to 3% Mg, at most 2.5% Cu, Fe<0.25%, and Si≤0.12%. More particularly, the invention relates to a method of manufacturing aluminum wrought products in relatively thick gauges, i.e. about 30 to 300 mm thick. While typically practiced on rolled plate product forms, this invention may also find use with manufacturing extrusions or forged product shapes. Representative structural component parts made from the alloy product include integral spar members and the like which are machined from thick wrought sections, including rolled plate. This invention is particularly suitable for manufacturing high strength extrusions and forged aircraft components. Such aircraft include commercial passenger jetliners, cargo planes and certain military planes. In addition, non-aerospace parts like various thick mold plates or tooling plates may be made according to this invention.

BACKGROUND TO THE INVENTION

As will be appreciated herein below, except as otherwise indicated, alloy designations and temper designations refer to the Aluminum Association designations in Aluminum Standards and Data and the Registration Records, as published by the Aluminum Association in 2006.

For any description of alloy compositions or preferred alloy compositions, all references to percentages are by weight percent unless otherwise indicated.

Different types of aluminum alloys have been used in the past for forming a variety of products for structural applications in the aerospace industry. Designers and manufacturers in the aerospace industry are constantly trying to improve fuel efficiency, product performance and constantly trying to reduce the manufacturing and service costs. The preferred method for achieving the improvements, together with the cost reduction, is the uni-alloy concept, i.e. one aluminum alloy that is capable of having improved property balance in the relevant product forms.

State of the art at this moment is high damage tolerant AA2x24 (i.e. AA2524) or AA6x13 or AA7x75 for fuselage sheet, AA2324 or AA7x75 for lower wing, AA7055 or AA7449 for upper wing and AA7050 or AA7010 or AA7040 or AA7140 for wing spars and ribs or other sections machined from thick plate. The main reason for using different alloys for each different application is the difference in the property balance for optimum performance of the whole structural part.

For fuselage skin, damage tolerant properties under tensile loading are considered to be very important, that is a combination of fatigue crack growth rate ("FCGR"), plane stress fracture toughness and corrosion. Based on these property requirements, high damage tolerant AA2×24-T351 (see e.g. U.S. Pat. No. 5,213,639 or EP-1026270-A1) or Cu containing AA6xxx-T6 (see e.g. U.S. Pat. Nos. 4,589,932, 5,888,320, US-2002/0039664-A1 or EP-1143027-A1) would be the preferred choice of civilian aircraft manufactures.

For lower wing skin a similar property balance is desired, but some toughness is allowably sacrificed for higher tensile strength. For this reason AA2x24 in the T39 or a T8x temper are considered to be logical choices (see e.g. U.S. Pat. Nos. 5,865,914, 5,593,516 or EP-1114877-A1).

For upper wing, where compressive loading is more important than the tensile loading, the compressive strength, fatigue (SN-fatigue or life-time or FCGR) and fracture toughness are the most critical properties. Currently, the preferred choice would be AA7150, AA7055, AA7449 or AA7x75 (see e.g. U.S. Pat. Nos. 5,221,377, 5,865,911, 5,560,789 or 5,312,498). These alloys have high compressive yield strength with at the moment acceptable corrosion resistance and fracture toughness, although aircraft designers would welcome improvements on these property combinations.

For thick sections having a thickness of more than 3 inch or parts machined from such thick sections, a uniform and reliable property balance through thickness is important. Currently, AA7050 or AA7010 or AA7040 (see U.S. Pat. No. 6,027,582) or AA7085 (see e.g. US-2002/0121319-A1 and U.S. Pat. No. 6,972,110) are used for these types of applications. Reduced quench sensitivity, that is deterioration of properties through thickness with lower quenching speed or thicker products, is a major wish from the aircraft manufactures. Especially the properties in the ST-direction are a major concern of the designers and manufactures of structural parts.

A better performance of the aircraft, i.e. reduced manufacturing cost and reduced operation cost, can be achieved by improving the property balance of the aluminum alloys used in the structural part and preferably using only one type of alloy to reduce the cost of the alloy and to reduce the cost in the recycling of aluminum scrap and waste.

Accordingly, it is believed there is a demand for an aluminum alloy capable of achieving the improved proper property balance in almost every relevant product form.

DESCRIPTION OF THE INVENTION

It is an object of the present invention to provide AA7000-series aluminum alloys having an improved property balance.

It is another object of the present invention to provide a wrought aluminum alloy product of an AA7000-series alloy comprising 3 to 10% Zn, 1 to 3% Mg, at most 2.5% Cu, Fe<0.25%, and Si<0.12, and having improved properties, in particular having improved fracture toughness.

It is another object of the present invention to provide a method of manufacturing AA7000-series alloys having improved properties.

These and other objects and further advantages are met or exceeded by the present invention concerning a method of manufacturing a wrought aluminum alloy product of an AA7000-series alloy comprising 3 to 10% Zn, 1 to 3% Mg, at most 2.5% Cu, Fe<0.25%, and Si<0.12%, the method comprising the steps of:

a. casting stock of an ingot of the defined AA7000-series aluminum alloy composition;
b. preheating and/or homogenising the cast stock;
c. hot working the stock by one or more methods selected from the group consisting of rolling, extrusion, and forging;
d. optionally cold working the hot worked stock;
e. solution heat treating ("SHT") of the hot worked and optionally cold worked stock at a temperature and time sufficient to place into solid solution the soluble constituents in the aluminum alloy;

f. cooling the SHT stock, preferably by one of spray quenching or immersion quenching in water or other quenching media;

g. optionally stretching or compressing of the cooled SHT stock or otherwise cold working the cooled SHT stock to relieve stresses, for example levelling or drawing or cold rolling of the cooled SHT stock, h. ageing the cooled and optionally stretched or compressed or otherwise cold worked SHT stock to achieve a desired temper.

According to this invention there is at least one heat treatment carried out at a temperature in a range of more than 500° C. but lower than the solidus temperature of the subject AA7000 aluminum alloy, and wherein this heat treatment is to dissolve as much as possible all the $Mg_2Si$ phases present in the alloy product and is carried out either: (i) after the homogenisation heat treatment but prior to hot working, or (ii) after the solution heat treatment of step e.), or (iii) both after the homogenisation heat treatment but prior to hot working and also after the solution heat treatment of step e.).

The aluminum alloy can be provided as an ingot or slab or billet for fabrication into a suitable wrought product by casting techniques regular in the art for cast products, e.g. DC-casting, EMC-casting, EMS-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is well-known in the art. After casting the alloy stock, the ingot is commonly scalped to remove segregation zones near the cast surface of the ingot.

It is known in the art that the purpose of a homogenisation heat treatment has the following objectives: (i) to dissolve as much as possible coarse soluble phases formed during solidification, and (ii) to reduce concentration gradients to facilitate the dissolution step. A preheat treatment achieves also some of these objectives. A typical preheat treatment for AA7000-series alloys would be a temperature of 420 to 460° C. with a soaking time in the range of 3 to 50 hours, more typically for 3 to 20 hours.

Firstly the soluble eutectic phases such as the S-phase, T-phase, and M-phase in the alloy stock are dissolved using regular industry practice. This is typically carried out by heating the stock to a temperature of less than 500° C., typically in a range of 450 to 485° C., as S-phase eutectic phase ($Al_2MgCu$-phase) have a melting temperature of about 489° C. in AA7000-series alloys and the M-phase ($MgZn_2$-phase) has a melting point of about 478° C. As is known in the art this can be achieved by a homogenisation treatment in said temperature range and allowed to cool to the hot working temperature, or after homogenisation the stock is subsequently cooled and reheated before hot working. The regular homogenisation process can also be done in a two or more steps if desired, and which are typically carried out in a temperature range of 430 to 490° C. for AA7000-series alloys. For example in a two step process, there is a first step between 457 and 463° C., and a second step between 470 and 485° C., to optimise the dissolving process of the various phases depending on the exact alloy composition.

The soaking time at the homogenisation temperature according to industry practice is alloy dependent as is well known to the skilled person, and is commonly in the range of 1 to 50 hours. The heat-up rates that can be applied are those which are regular in the art.

This is where the homogenisation practice according to the prior art stops. However, it is an important aspect of the present invention that after the regular homogenisation practice where the alloy composition allows complete dissolution of soluble phases (eutectics) present from solidification at least one further heat treatment is carried out at a temperature in a range of more than 500° C., but at a temperature lower than the solidus temperature of the subject alloy.

For the AA7000-series alloys the preferred temperature is in a range of >500 to 550° C., preferably 505 to 540° C., and more preferably 510 to 535° C., and furthermore preferably of at least 520° C.

For the alloy system the soaking time at this further heat treatment is from about 1 to about 50 hours. A more practical soaking time would not be more than about 30 hours, and preferably not more than about 15 hours. A too long soaking time at too high a temperature may lead to an undesired coarsening of dispersoids adversely affecting the mechanical properties of the final alloy product.

The skilled person will immediately recognise that at least the following alternative homogenisation practices can be used, while achieving the same technical effect:

(a) regular homogenisation according to industry practice, wherein afterwards the temperature is further raised to carry out the additional step according to this invention, followed by cooling to hot working temperature, such as, for example, 470° C.

(b) as alternative (a), but wherein after the additional step according to this invention the stock is cooled, for example to ambient temperature, and subsequently reheated to hot working temperature.

(c) as alternative (a), but wherein between the heat treatment according to regular industry practice and the further heat treatment according to this invention the stock is cooled, for example to below 150° C. or to ambient temperature, (d) a practice wherein between the various steps (regular practice, heat treatment according to invention, and heating to hot working temperature) the stock is cooled, for example to below 150° C. or ambient temperature, where after it is reheated to the relevant temperature.

In the alternatives wherein following the heat treatment according to this invention the stock is first cooled to, for example, ambient prior to reheating for hot working, preferably a fast cooling rate is used to prevent or minimise uncontrolled precipitation of various secondary phases, e.g. $Al_2CuMg$ or $Al_2Cu$ or $Mg_2Zn$.

Following the preheat and/or homogenisation practice according to this invention the stock can be hot worked by one or more methods selected from the group consisting of rolling, extrusion, and forging, preferably using regular industry practice. The method of hot rolling is preferred for the present invention.

The hot working, and hot rolling in particular, may be performed to a final gauge, e.g. 3 mm or less or alternatively thick gauge products. Alternatively, the hot working step can be performed to provide stock at intermediate gauge, typical sheet or thin plate. Thereafter, this stock at intermediate gauge can be cold worked, e.g. by means of rolling, to a final gauge. Depending on the alloy composition and the amount of cold work an intermediate anneal may be used before or during the cold working operation.

In an embodiment of the method according to this invention following the regular practice of SHT and fast cooling for the subject aluminum alloy product, the stock is subjected to a further heat treatment, one may designate this as a second SHT, at a higher temperature than the first regular SHT, where after the stock is rapidly cooled to avoid undesirable precipitation out of various phases. Between the first SHT and second SHT the stock can be rapidly cooled according to regular practice, or alternatively the stock is ramped up in temperature from the first to the second SHT and after a sufficient soaking time it is subsequently rapidly cooled. This second SHT is to further enhance the properties in the alloy products and is preferably carried out in the same temperature range and time range as the homogenisation treatment according to this invention as set out in this description, together with the preferred narrower ranges. However, it is believed that also shorter soaking times can still be very useful, for example in the range of about 2 to 180 minutes. This further heat treatment may dissolve as much as practically possible any of the $Mg_2Si$ phases which may have precipitated out during cooling from the homogenisation treatment or the during a hot working operation or any other intermediate thermal treatment. The solution heat treatment is typically carried out in a batch furnace, but can also be carried out in a continuous fashion. After solution heat treatment, it is important that the aluminum alloy be cooled to a temperature of 175° C. or lower, preferably to ambient temperature, to prevent or minimise the uncontrolled precipitation of secondary phases, e.g. $Al_2CuMg$ and $Al_2Cu$, and/or $Mg_2Zn$. On the other hand cooling rates should preferably not be too high to allow for a sufficient flatness and low level of residual stresses in the product. Suitable cooling rates can be achieved with the use of water, e.g. water immersion or water jets.

The stock may be further cold worked, for example, by stretching in the range of 0.5 to 8% of its original length to relieve residual stresses therein and to improve the flatness of the product. Preferably the stretching is in the range of 0.5 to 6%, more preferably of 0.5 to 5%.

After cooling the stock is aged, typically at ambient temperatures, and/or alternatively the stock can be artificially aged. The artificial ageing can be of particular use for higher gauge products. Depending on the alloy system this ageing can de done by natural ageing, typically at ambient temperatures, or alternatively by artificially ageing. All ageing practices known in the art and those which may be subsequently developed can be applied to the AA7000-series alloy products obtained by the method according to this invention to develop the required strength and other engineering properties.

A desired structural shape is then machined from these heat treated plate sections, more often generally after artificial ageing, for example, an integral wing spar. SHT, quench, stress relief operations and artificial ageing are also followed in the manufacture of thick sections made by extrusion and/or forged processing steps.

The effect of the homogenisation practice according to this invention alone or in combination with the second SHT, is that the damage tolerance properties are improved, or at least not adversely affected, of the alloy product compared to the same alloy processed without this practice according to the present invention. In particular an improvement can be found in one or more of the following properties: the fracture toughness, the fracture toughness in S-L orientation, the fracture toughness in S-T orientation, the elongation at fracture, the elongation at fracture in ST orientation, the fatigue properties, in particular FCGR, S-N fatigue or axial fatigue, the corrosion resistance, in particular exfoliation corrosion resistance, or SCC or IGC.

The following explanation for the surprisingly improved properties of the wrought product obtained by the method of this invention is put forward, with the caveat that it is merely an expression of belief and does not presently have complete experimental support.

The prior art refers to the $Mg_2Si$ constituent phase as being insoluble in AA7000-series aluminum alloys and these particles are known fatigue initiation sites. In particular for aerospace applications, the prior art indicates that the Fe and Si content needs to be controlled to very low levels to provide products with improved damage tolerant properties such as Fatigue Crack Growth Rate resistance ("FCGR") and fracture toughness. From various prior art documents it is clear that the Si content is treated as an impurity and should be kept at a level as low as reasonably possible. For example US-2002/0121319-A1, incorporated herein by reference, discusses the impact of these impurities on the alloying additions and states that Si will tie up some Mg thereby leaving an "Effective Mg" content available for solution, it is suggested that this be remedied by additional additions of Mg to compensate for the Mg tied up with the $Mg_2Si$, see section [0030] of US-2002/0121319-A1. However, at no point it is suggested that the $Mg_2Si$ could be reintroduced into solution by a controlled heat treatment practice. With regard to the homogenisation practice it is mentioned that homogenisation may be conducted in a number of controlled steps but ultimately state that a preferred combined total volume fraction of soluble and insoluble constituents be kept low, preferably below 1% volume, see section [0102] of US-2002/0121319-A1. Within the examples, times and temperatures of heat treatments are given but at no point are the temperatures or times disclosed adequate in attempting the dissolution of $Mg_2Si$ constituent particles, i.e. homogenisation temperature of up to 900° F. (482° C.) and solution treatment temperature of up to 900° F. (482° C.).

However, it has been found in accordance with the invention that for various AA7000-series aluminum alloys, the generally perceived constituent phase $Mg_2Si$ is substantially soluble via carefully controlled heat treatment and if they cannot be taken in complete solution then their morphology can be spherodised in such a way that fatigue and/or fracture toughness properties are improved. Once in solid solution, the Si and/or Mg will be available for subsequent ageing that may further enhance mechanical and corrosion properties. Thus the generally perceived detrimental impurity element Si is being converted into an element having an advantageous technical effect.

Yet, in a further embodiment of this invention the defined AA7000-series alloy product are processed using regular homogenisation and/or preheat practice (without the at least one heat treatment which is carried out at a temperature in a range of more than 500° C. for the AA7000-alloy but lower than the solidus temperature of the subject alloy), and wherein afterwards the products are processed using the preferred second SHT as set out above. Thus, this embodiment employs the first regular SHT followed by the second solution heat treatment in the above-defined temperature and time ranges (for example the above-defined preferred narrower ranges) at a higher temperature than the first regular SHT. This will result in the same advantages in product properties. It is possible to carry out the first regular SHT followed by rapid cooling and reheating to the soaking temperature of the second SHT, alternatively the temperature is ramped up from the first to the second SHT and after a sufficient soaking time it is subsequently rapidly cooled.

A wrought AA7000-series alloy product that can be processed favorably according to the method of this invention, comprises, in wt. %:

| | |
|---|---|
| Zn | about 3 to 10% |
| Mg | about 1 to 3% |
| Cu | 0 to about 2.5% |
| Fe | <0.25%, preferably <0.10% |
| Si | 0.01 to ≤0.12%, preferably 0.01 to 0.09%, |

one or more elements selected from the group consisting of:

| | |
|---|---|
| Zr | at most about 0.5, preferably 0.03 to 0.20 |
| Ti | at most about 0.3 |
| Cr | at most about 0.4 |
| Sc | at most about 0.5 |
| Hf | at most about 0.3 |
| Mn | at most about 0.4, preferably <0.3 |
| V | at most about 0.4 |
| Ag | at most about 0.5%, |

the alloy optionally containing at most:

about 0.05 Ca about 0.05 Sr about 0.004 Be, balance being Al, incidental elements and impurities. Typically such impurities are present each<0.05%, total<0.15%.

In a preferred embodiment of the alloys processed using the method according to this invention have a lower limit for the Zn-content of about 5.5%, and preferably about 6.1%, and more preferably of about 6.4%. And a more preferred upper limit for the Zn content is about 8.5%, and more preferably about 8.0%.

In a preferred embodiment, the alloys processed using the method according to this invention have a preferred upper limit for the Mg content of about 2.5%, and preferably about 2.0%, and more preferably of about 1.85%.

In a preferred embodiment, the alloys processed using the method according to this invention have a lower limit for the Cu-content of about 0.9% and more preferably about 1.1%. In a more preferred embodiment, the upper limit for the Cu content is about 2.1%, and more preferably about 1.9%.

Traditionally, beryllium additions have served as a deoxidizer/ingot cracking deterrent. Though for environmental, health and safety reasons, more preferred embodiments of this invention are substantially Be-free. Minor amounts of Ca and Sr alone or in combination can be added to the alloy for the same purposes as Be.

The Fe content for the alloy should be less than 0.25%. When the alloy product is used for aerospace application preferably the lower-end of this range is preferred, e.g. less than about 0.10%, and more preferably less than about 0.08% in order to maintain in particular the toughness at a sufficiently high level. Where the alloy product is used for tooling plate application, a higher Fe content can be tolerated. However, it is believed that also for aerospace application a moderate Fe content, for example about 0.09 to 0.13%, or even about 0.10 to 0.15%, can be used. Although the skilled person would believe this has an adverse effect on the toughness of the product, some of this loss in properties, if not all, is gained back when using the method according to this invention. The resultant would be an alloy product, having moderate Fe levels, but when processed according to this invention it has properties equivalent to the same alloy product except for a lower Fe content, e.g. 0.05 or 0.07%, when processed using regular practice. Thus similar properties are achieved at higher Fe-levels, which has a significant cost advantage as source material having very low Fe-contents is expensive.

Silver in a range of at most about 0.5% can be added to further enhance the strength during ageing. A preferred lower limit for the Ag addition would be about 0.03% and more preferably about 0.08%. A preferred upper limit would be about 0.4%.

Each of the dispersoid forming elements Zr, Sc, Hf, V, Cr and Mn can be added to control the grain structure and the quench sensitivity. The optimum levels of dispersoid formers depend on the processing, but when one single chemistry of main elements (Zn, Cu and Mg) is chosen within the preferred window and that chemistry will be used for all relevant products forms, then Zr levels are less than about 0.5%.

A preferred maximum for the Zr level is 0.2%. A suitable range of the Zr level is about 0.03 to 0.20%. A more preferred upper-limit for the Zr addition is about 0.15%. Zr is a preferred alloying element in the alloy product when processed according to this invention. Although Zr can be added in combination with Mn, for thicker gauge products manufactured using the method of this invention it is preferred that when Zr is added that any addition of Mn is avoided, preferably by keeping Mn at a level of less than 0.03%. In thicker gauge product the Mn phases coarsens more rapid than the Zr phases, thereby adversely affecting the quench sensitivity of the alloy product.

The addition of Sc is preferably not more than about 0.5% or more preferably not more than 0.3%, and even more preferably not more than about 0.18%. When combined with Sc, the sum of Sc+Zr should be less then 0.3%, preferably less than 0.2%, and more preferably a maximum of about 0.17%, in particular where the ratio of Zr and Sc is between 0.7 and 1.4%.

Another dispersoid former that can be added, alone or with other dispersoid formers is Cr. Cr levels should preferably be below about 0.4%, and more preferably a maximum of about 0.3%, and even more preferably about 0.2%. A preferred lower limit for the Cr would be about 0.04%. Although Cr alone may not be as effective as solely Zr, at least for use in tooling plate of the alloy wrought product, similar hardness results may be obtained. When combined with Zr, the sum of Zr+Cr should not be above about 0.23%, and preferably not more than about 0.18%.

The preferred sum of Sc+Zr+Cr should not be above about 0.4%, and more preferably not more than 0.27%.

In another embodiment of the aluminum alloy wrought product according to the invention the alloy product is free of Cr, in practical terms this would mean that the Cr content is at regular impurity levels of<0.05%, and preferably<0.02%, and more preferably the alloy is essentially free or substantially free from Cr. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product. In particular for thicker gauge products (e.g. more than 3 mm) the Cr ties up some of the Mg to form $Al_{12}Mg_2Cr$ particles which adversely affect quench sensitivity of the wrought alloy product, and may form coarse particles at the grain boundaries thereby adversely affecting the damage tolerance properties.

Mn can be added as a single dispersoid former or in combination with one of the other dispersoid formers. A maximum for the Mn addition is about 0.4%. A suitable range for the Mn addition is in the range of about 0.05 to 0.4%, and preferably in the range of about 0.05 to 0.3%. A preferred lower limit for the Mn addition is about 0.12%. When combined with Zr, the sum of Mn plus Zr should be less then about 0.4%, preferably less than about 0.32%, and a suitable minimum is about 0.12%.

In another embodiment of the aluminum alloy wrought product according to the invention the alloy is free of Mn, in practical terms this would mean that the Mn-content is<0.03%, and preferably<0.02%, and more preferably the alloy is essentially free or substantially free from Mn. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product.

In another preferred embodiment of the aluminum alloy wrought product according to this invention the alloy has no deliberate addition of V such that it is only present, if present, at regular impurity levels of less than 0.05%, preferably less than 0.02%.

In another embodiment, the alloys processed with the method according to this invention have a chemical composition within the ranges of AA7010, AA7040, AA7140, AA7050, AA7081, or AA7085, plus modifications thereof.

In a preferred embodiment the wrought AA7000-series alloy product that can be processed favorably according to this invention, consists essentially of, in wt. %:

| | |
|---|---|
| Zn | about 3 to 10% |
| Mg | about 1 to 3% |
| Cu | 0 to about 2.5% |
| Fe | <0.25%, preferably <0.10% |
| Si | 0.01 to ≤0.12%, preferably 0.01 to 0.09%, |

one or more elements selected from the group consisting of:

| | |
|---|---|
| Zr | at most about 0.5, preferably 0.03 to 0.20 |
| Ti | at most about 0.3 |
| Cr | at most about 0.4 |
| Sc | at most about 0.5 |
| Hf | at most about 0.3 |
| Mn | at most about 0.4, preferably <0.3 |
| Ag | at most about 0.5%, |

the alloy optionally containing at most:

about 0.05 Ca
about 0.05 Sr
about 0.004 Be, balance being Al, incidental elements and impurities. Typically such impurities are present each<0.05%, total<0.15%.

In another preferred embodiment the wrought AA7000-series alloy product that can be processed favourably according to this invention, consists essentially of, in wt. %:

| | |
|---|---|
| Zn | 7.0 to 8.0 |
| Mg | 1.2 to 1.8 |
| Cu | 1.3 to 2.0 |
| Fe | <0.10, preferably <0.08 |
| Si | 0.01 to 0.09, preferably 0.01 to 0.06 |
| Zr | 0.08 to 0.15 |
| Mn | <0.04, preferably <0.02 |
| Cr | <0.04, preferably <0.02 |
| Ti | <0.06, |

the alloy optionally containing at most:

about 0.05 Ca
about 0.05 Sr
about 0.004 Be, balance being Al, incidental elements and impurities. Typically such impurities are present each<0.05%, total<0.15%.

The AA7000-series alloy product when manufactured according to this invention can be used as an aerospace structural component, amongst others as fuselage sheet, fuselage frame member, upper wing plate, lower wing plate, thick plate for machined parts, thin sheet for stringers, spar member, rib member, floor beam member, and bulkhead member.

In the following, the invention will be explained by the following non-limitative examples.

EXAMPLES

Example 1

On a pilot scale of testing a billet has been DC-cast having a diameter of 250 mm and a length of over 850 mm. The alloy composition is listed in Table 1. Alloy 3 would be a typical example of the AA7085 series alloy having a slightly increased Fe content. From the billet two rolling blocks have been machined having dimensions of 150×150×300 mm. By following this route blocks with an identical chemistry were obtained which making it easier to fairly assess the influence of the heat treatments at a later stage. The blocks were all homogenised using the same cycles of 19 hours at 470° C. whereby industrial heat up rates and cooling rates were applied. Depending on the block a further homogenisation treatment according to the invention was applied whereby the furnace temperature is further increased and where after a second heat treatment homogenisation treatment of 10 hours at 525° C. was applied.

Following the homogenisation the blocks were cooled to room temperature. Thereafter all the blocks were preheated for 5 hours at 450° C. in one batch and hot rolled from 150 to 60 mm. The entrance temperatures (surface measurements) were in the range of 430 to 440° C. and mill exit temperatures varied in the range of 380 to 390° C. After hot rolling the plates received a one or two step solution heat treatment followed by a cold water quench. After a delay of 72 hours the plates were aged to the same T76 temper using a 3-step ageing practice, viz. 6 hours at 120° C., then 12 hours at 154° C. and followed by 24 hours at 120° C. The plates were not stretched prior to ageing. All heat treatments are summarised in Table 2. Due to circumstances at the rolling mill Sample 3B1 was lost and could not be tested for its mechanical properties.

The average mechanical properties according to ASTM-B557 standard over 2 samples of the 60 mm plates produced with the various heat treatments are listed in Table 3 and wherein "TYS" stands for Tensile Yield Strength in MPa, UTS for Ultimate Tensile Strength in MPa, and "Kq" for the qualitative fracture toughness in MPa·√m. The fracture toughness has been measured in accordance with ASTM B645. The L, LT, L-T and T-L testing was done at ¼T while ST tensile testing and S-L fracture toughness was done at ½T.

TABLE 1

Composition of the alloys, in wt. %, balance Al and regular impurities.

| Alloy | Si | Fe | Cu | Mn | Mg | Cr | Zn | Ti | Zr |
|---|---|---|---|---|---|---|---|---|---|
| 3 | 0.07 | 0.08 | 1.7 | <0.01 | 1.5 | <0.01 | 7.6 | 0.04 | 0.12 |

TABLE 2

Sample codes -v- various heat treatment routes.

| Sample | Homogenisation | Preheat | SHT | T76 ageing |
|---|---|---|---|---|
| 3A1 | 19 hrs@470° C. | 5 hrs@450° C. | 2 hrs@475° C. | 3 step |
| 3A2 | 19 hrs@470° C. | 5 hrs@450° C. | 2 hrs@475 + 1 hr@525° C. | 3 step |
| 3B1 | 19 hrs@470 + 10 hrs@525° C. | 5 hrs@450° C. | 2 hrs@475° C. | 3 step |
| 3B2 | 19 hrs@470 + 10 hrs@525° C. | 5 hrs@450° C. | 2 hrs@475 + 1 hr@525° C. | 3 step |

TABLE 3

Mechanical properties of the various 60 mm plates.

| | L | | LT | | ST | | Kq | | |
|---|---|---|---|---|---|---|---|---|---|
| Sample | TYS | UTS | TYS | UTS | TYS | UTS | L-T | T-L | S-L |
| 3A1 | 495 | 517 | 506 | 530 | 456 | 462 | 34.5 | 30 | 25 |
| 3A2 | 518 | 541 | 530 | 556 | 493 | 513 | 41.7 | 32 | 29 |
| 3B1 | — | — | — | — | — | — | — | — | — |
| 3B2 | 518 | 543 | 532 | 555 | 484 | 500 | 42.8 | 34.6 | 30 |

From the results of Table 3 with respect to the mechanical properties the following can be seen:

Compared to standard processing (Sample 3A1) the variants with a two step treatment according to the invention (Samples 3A2, 3B2) show a significant increase in toughness. It seems that a combined two step homogenisation treatment (Sample 3B2) plus a two step SHT according to this invention provides the best toughness results. Although the test results for the two step homogenisation plus standard SHT are missing, it appears nevertheless fair to conclude that a two step homogenisation according to this invention provides an improvement in toughness. It is believed that the toughness can be further improved by lowering the Fe content in the aluminum alloy.

A significant increase in strength is observed of about 20-30 MPa for the two step SHT variant.

Example 2

In a similar approach as with Example 1, a Cu-free 7xxx-series alloy has been produced, the chemical composition is listed in Table 4. The alloy composition falls within the compositional range of AA7021. This alloy was processed in a similar approach as for Example 1 and the thermal history is listed in Table 5. The ageing treatment after SHT+cold water quench consisted of 24 hours at 120° C. The plates were not stretched prior to ageing. The average mechanical properties measured are listed in Table 6, and wherein "El" stands for elongation at fracture in %.

TABLE 4

Composition of the alloys, in wt. %, balance Al and regular impurities.

| Alloy | Si | Fe | Cu | Mn | Mg | Cr | Zn | Ti | Zr |
|---|---|---|---|---|---|---|---|---|---|
| 5 | 0.04 | 0.07 | <0.01 | <0.01 | 1.21 | <0.01 | 5.1 | 0.04 | 0.12 |

TABLE 5

Sample codes -v- various heat treatment routes.

| Sample | Homogenisation | Preheat | SHT | ageing |
|---|---|---|---|---|
| 5A1 | 8 hrs@470° C. | 5 hrs@450° C. | 2 hrs@475° C. | 24 hrs@120° C. |
| 5A2 | 8 hrs@470° C. | 5 hrs@450° C. | 2 hrs@475 + 1 hr@525° C. | 24 hrs@120° C. |
| 5B1 | 8 hrs@470 + 9 hrs@525° C. | 5 hrs@450° C. | 2 hrs@475° C. | 24 hrs@120° C. |
| 5B2 | 8 hrs@470 + 9 hrs@525° C. | 5 hrs@450° C. | 2 hrs@475 + 1 hr@525° C. | 24 hrs@120° C. |

TABLE 6

Mechanical properties of the various 60 mm plates.

| | L | | | LT | | | ST | | | Kq | | |
|---|---|---|---|---|---|---|---|---|---|---|---|---|
| Sample | TYS | UTS | El | TYS | UTS | El | TYS | UTS | EL | L-T | T-L | S-L |
| 5A1 | 319 | 360 | 22.0 | 322 | 374 | 16.9 | 310 | 348 | 2.9 | 55 | 51 | 32 |
| 5A2 | 316 | 362 | 21.2 | 320 | 373 | 17.4 | 309 | 355 | 5.5 | 55 | 58 | 35 |
| 5B1 | 318 | 363 | 22.8 | 321 | 374 | 17.6 | 312 | 361 | 5.3 | 62 | 50 | 33 |
| 5B2 | 309 | 367 | 20.0 | 321 | 375 | 18.7 | 313 | 366 | 7.5 | 52 | 56 | 35 |

From the results of Table 6 with respect to the mechanical properties the following can be seen:

Compared to standard processing (Sample 5A1) the variants with a two step treatment according to the invention (Samples 5A2, 5B1, and 5B2) show an increase in toughness. It seems that a combined two step homogenisation treatment (Sample 5B2) plus a two step SHT according to this invention provides the best overall toughness results. It is believed that the toughness can be further improved by lowering the Fe content in the aluminum alloy. Also the elongation, in particular in ST direction, is significantly improved using the process according to this invention.

The strength is for all variants (5A1 to 5B2) about the same. An increase in ultimate strength and yield strength is not observed in contrast to the results of Example 1 for the Cu containing AA7xxx-series alloys. This result cannot be readily explained.

Having now fully described the invention, it will be apparent to one of ordinary skill in the art that many changes and modifications can be made without departing from the spirit or scope of the invention as herein described.

The invention claimed is:

1. A method of manufacturing a wrought aluminium alloy product of an AA7000-series alloy, the method consisting of the following steps:

a. casting stock of an ingot of an AA7000-series aluminium alloy having a chemical composition comprising, in wt. %:
   Zn about 6.4 to 10%
   Mg about 1 to 1.5%
   Cu 0.9 to about 2.5%
   Fe<0.25%
   Si≤0.12%,
   Mn<0.02%,
   balance being Al, incidental elements and impurities;
b. preheating and/or homogenizing the cast stock at a temperature of less than 500° C.;
c. heat treating the cast stock at a temperature in a range of more than 500° C. but lower than the solidus temperature of the subject aluminium alloy;
d. hot working the stock by one or more methods selected from the group consisting of rolling and extruding;
e. optionally cold working the hot-worked stock;
f. first solution heat treating (SHT) of the hot-worked and optionally cold-worked stock, wherein the first solution heat treating is at a temperature and a time sufficient to place into solid solution soluble constituents in the aluminum alloy;
g. second solution heat treating of the worked stock at a higher temperature than the first SHT the temperature being in a range of more than 500° C. but lower than the solidus temperature of the subject aluminium alloy in a time range of 2 to 180 minutes wherein the second SHT step dissolves $Mg_2Si$ in the alloy;
h. cooling the SHT stock;
i. stretching or compressing the cooled SHT stock or otherwise cold working the cooled SHT stock to release stresses;
j. ageing the cooled and stretched or compressed or otherwise cold-worked SHT stock to achieve a desired temper.

2. Method according to claim 1, wherein the AA7000-series aluminum alloy wrought product further comprises, in wt. %:

one or more elements selected from the group consisting of:

| | |
|---|---|
| Zr | at most 0.5 |
| Ti | at most 0.3 |
| Cr | at most 0.4 |
| Sc | at most 0.5 |
| Hf | at most 0.3 |
| Mn | at most 0.4 |
| V | at most 0.4, |
| Ag | at most 0.5. |

3. Method according to claim 1, wherein the AA7000-series aluminum alloy wrought product further comprising, in wt. %, at most about 0.05% Ca, at most 0.05% Sr, at most 0.004% Be.

4. Method according to claim 1, wherein the AA7000-series aluminum alloy wrought product has a Si-content in the range of 0.01 to≤0.12%.

5. Method according to claim 1, wherein the AA7000-series aluminum alloy wrought product has a Si-content in the range of about 0.01 to 0.09%.

6. Method according to claim 1, wherein the AA7000-series aluminum alloy wrought product has an Fe content of less than 0.15%.

7. Method according to claim 1, wherein the AA7000-series aluminum alloy wrought product has an Fe content of less than 0.10%.

8. Method according to claim 1, wherein the AA7000-series aluminum alloy wrought product has a Zn content of about 6.4 to 8.5%.

9. Method according to claim 1, wherein the AA7000-series aluminum alloy wrought product has a Zn content of about 6.4 to 8.0%.

10. Method according to claim 1, wherein the preheating and/or homogenizing the cast stock is at a temperature in a range of 430 to 490° C.

11. Method according to claim 1, wherein the preheating and/or homogenizing the cast stock is at a temperature in a range of 450 to 485° C.

12. Method according to claim 1, wherein the AA7000-series aluminum alloy wrought product has a Cu content of about 1.1 to 2.5%.

13. Method according to claim 1, wherein the AA7000-series aluminum alloy wrought product has a Cu content of about 1.1 to 2.1%.

14. Method according to claim 1, wherein the AA7000-series aluminum alloy wrought product has a Cu content of about 1.1 to 1.9%.

15. Method according to claim 1, wherein the AA7000-series aluminum alloy wrought product further comprises a Zr content in a range of 0.03 to 0.2%.

16. Method according to claim 1, wherein the AA7000-series aluminum alloy wrought product further comprises a Cr content of<0.05%.

17. Method according to claim 1, wherein the AA7000-series aluminum alloy wrought product has a chemical composition of an alloy selected from the group of AA7010, AA7040, AA7140, AA7050, AA7081, and AA7085.

18. Method according to claim 1, wherein the AA7000-series aluminum alloy wrought product has a chemical composition within the range of AA7085.

19. Method according to claim 1, wherein the heat treating after homogenizing prior to hot working and the second solution heat treating are carried out at a temperature range of >500-550° C.

20. Method according to claim 1, wherein the heat treating after homogenizing prior to hot working and the second solution heat treating are carried out at a temperature range of at least 510° C. but lower than the solidus temperature of the subject aluminium alloy.

21. Method according to claim 1, wherein the heat treating after homogenizing prior to hot working and the second solution heat treating are carried out at a temperature range of at least 520° C. but lower than the solidus temperature of the subject aluminium alloy.

22. Method according to claim 1, wherein the heat treating after homogenizing prior to hot working and the second solution heat treating are carried out at a temperature range of more than 500° C. but at most 540° C.

23. Method according to claim 1, wherein the heat treating after homogenizing prior to hot working and the second solution heat treating are carried out at a temperature range of more than 500° C. but at most 535° C.

24. Method according to claim 1, wherein the hot working during step d is carried out by rolling.

25. Method according to claim 1, wherein the hot working during step d is carried out by extrusion.

26. Method according to claim 1, wherein said alloy consists essentially of, in wt. %:

| | |
|---|---|
| Zn | about 6.4 to 10% |
| Mg | about 1 to 1.5% |
| Cu | 0.9 to 2.5% |
| Fe | <0.25% |
| Si | ≤0.12, |
| Mn | <0.02% |

one or more elements selected from the group consisting of:

| | |
|---|---|
| Zr | at most 0.5, |
| Ti | at most 0.3 |
| Cr | at most 0.4 |
| Sc | at most 0.5 |
| Hf | at most 0.3 |
| V | at most 0.4 |
| Ag | at most 0.5%, |

said alloy optionally containing at most:

| | |
|---|---|
| 0.05 | Ca |
| 0.05 | Sr |
| 0.004 | Be, |

balance being Al, incidental elements and impurities.

27. Method according to claim 1, wherein the AA7000-series aluminum alloy product has a gauge of at least 3 mm.

28. Method according to claim 1, wherein the AA7000-series aluminum alloy product has a gauge of at least 30 mm.

29. Method according to claim 1, the AA7000-series aluminum alloy product has a gauge in a range of 30 to 300 mm.

30. Method according to claim 1, wherein the AA7000-series aluminum alloy product is a product selected from the group consisting of fuselage sheet, fuselage frame member, upper wing plate, lower wing plate, thick plate for machined parts, thin sheet for stringers, spar member, rib member, floor beam member, and bulkhead member.

31. Method according to claim 1, wherein the AA7000-series aluminum alloy product is in the form a mold plate or a tooling plate.

32. Method according to claim 1, wherein the stretching or compressing comprises leveling or drawing or cold rolling of the cooled SHT stock.

33. The method of claim 1, wherein the preheating the cast stock at the temperature of 420-460° C. is for 3 to 50 hours and/or homogenizing the cast stock at the temperature of 450-485° C. is for 1 to 50 hours;

wherein heat treating the cast stock at a temperature in a range of at least 520° C. but lower than the solidus temperature of the subject aluminium alloy for 1 to 15 hours; and wherein the second solution heat treating is carried out at a temperature range of at least 520° C. but lower than the solidus temperature of the subject aluminium alloy.

34. The method of claim 33, wherein the first solution heat treating is at a temperature less than 500° C.

35. The method of claim 33, wherein the first solution heat treating is at a temperature in a range of 475° C. to less than 500° C.

36. The method of claim 33, wherein Si is in the range from 0.07 to 0.12%.

37. The method of claim 1, wherein Si is in the range from 0.07 to 0.12%.

* * * * *

UNITED STATES PATENT AND TRADEMARK OFFICE

CERTIFICATE OF CORRECTION

PATENT NO. : 8,608,876 B2
APPLICATION NO. : 11/773919
DATED : December 17, 2013
INVENTOR(S) : Sunil Khosla, Andrew Norman and Hugo Van Schoonevelt It is certified that error appears in the above-identified patent and that said Letters Patent is hereby corrected as shown below:

In the Claims

Claim 2, Column 14, Line 7: "~~Mn – at most 0.4~~" should be deleted.

Signed and Sealed this
Twenty-ninth Day of April, 2014

Michelle K. Lee

Michelle K. Lee
*Deputy Director of the United States Patent and Trademark Office*